United States Patent [19]

Anthone

[11] 3,998,481

[45] Dec. 21, 1976

[54] DRAW AND PULL LATCH

[75] Inventor: Leo E. Anthone, Little Canada, Minn.

[73] Assignee: Minnesota Mining and Manufacturing Company, St. Paul, Minn.

[22] Filed: May 1, 1975

[21] Appl. No.: 573,521

[52] U.S. Cl. ..... 292/104; 292/66; 292/113; 292/114; 292/256; 292/DIG. 49

[51] Int. Cl.[2] ..... B65D 45/06; E05C 5/00; E05C 13/02; E05C 19/14

[58] Field of Search ..... 292/63, 66, 113, 114, 292/123, 126, 97, 256, DIG. 31, DIG. 49, 104, 205; 70/83, 84

[56] References Cited

UNITED STATES PATENTS

| | | | |
|---|---|---|---|
| 2,859,996 | 11/1958 | Atkinson | 292/114 |
| 3,237,978 | 3/1966 | Swanson | 292/113 |
| 3,831,224 | 8/1974 | MacMaster et al. | 292/113 X |

FOREIGN PATENTS OR APPLICATIONS

| | | | |
|---|---|---|---|
| 253,939 | 12/1926 | United Kingdom | 292/113 |
| 382,769 | 11/1932 | United Kingdom | 292/113 |
| 233,701 | 12/1925 | United Kingdom | 292/66 |

*Primary Examiner*—Paul R. Gilliam
*Assistant Examiner*—Carl F. Pietruszka
*Attorney, Agent, or Firm*—Alexander, Sell, Steldt & DeLaHunt

[57] ABSTRACT

A draw and pull latch consisting of a base plate for attachment to a cabinet, a body pivoted at one end on the base plate and normally covering the base plate, and a draw and pull nose pivoted on the body parallel to and spaced from the body-base plate pivot. The body carries a pivotal latching plate aligned with at least one latching hook on the base plate and urged by a torsion spring to a latching position. In the fully latched position the draw and pull nose pivot axis is above a plane through the body-base plate pivot axis and the keeper engagement by the draw and pull nose so that the latch will urge itself to a fully open position when the latch plate is disengaged from the latching hook.

2 Claims, 5 Drawing Figures

DRAW AND PULL LATCH

FIELD OF THE INVENTION

A draw and pull latch for securely latching cabinet doors.

BACKGROUND OF THE INVENTION

Telephone cables are often run under ground with above ground cabinets providing access to the cables for adding or changing service. These cabinets must be securely latched to prevent vandals from disrupting telephone service.

Above ground telecommunications cabinets typically have two overlapping doors to permit access to the entire interior of the cabinet when the doors are open. A draw and pull type latch is commonly used on such cabinets to draw the cabinet doors into proper alignment and to latch them in that position. Such latches have until now been an over center type so that when moved to the fully latched position the forces on the latch urge it firmly to the latched position. This has now been found to be undesirable in that when the service man attempts to unlatch the latch he must also pry it open from its over center position to fully unlatch it.

THE PRESENT INVENTION

The draw and pull latch of the present invention comprises a rectangular base plate for attachment to one portion of the structure to be latched, formed along its two opposed edges at one end with similar upstanding pivot flanges and formed at its opposite end with at least one upstanding latching hook. A rectangular body having a top wall, two depending side walls and one depending end wall is pivoted at its open end on the base plate on the outside of the base plate pivot flanges. The body extends over the base plate to cover the base plate and it carries a pivoted latching plate formed with a latching flange in alignment with and opposed to the latching hook on the base plate. The latching plate is resiliently urged to a latching position by a torsion spring and it has its pivot extend through the body where it is formed for engagement for pivoting the latching plate to an unlatched position against the torsion spring. A draw and pull nose is pivoted at one end on the outside of the opposed body walls adjacent the open end of the body, the pivot axis being spaced from the open end of the body further than and parallel to the body pivot axis on the base plate. The nose covers the open end of the body and has a depending end wall turned back toward its opposed end for engaging a keeper on the structure to be latched. When the latch is in a fully latched position with the nose engaging a keeper and the latching hook engaging the latching flange on the latching plate, a plane through the keeper engaging area on the end wall of the draw and pull nose and the pivot axis of the body on the base plate lies between the pivot axis of the draw and pull nose and the base plate. When the latching plate is pivoted against its torsion spring to unlatch it from the latching hook the forces acting on the latch urge the body away from the base plate to fully unlatch the latch without any pulling or prying by the service man.

THE DRAWING

Figure 1:
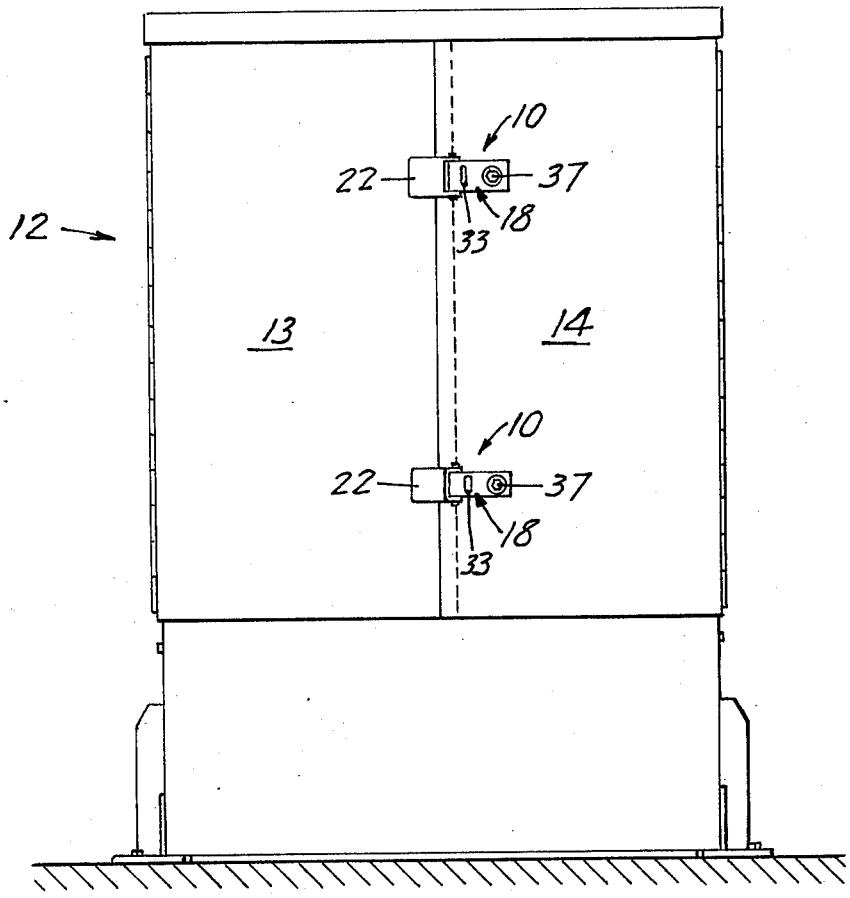
FIG. 1 is a front elevation view of an above ground cabinet utilizing two draw and pull latches constructed in accordance with the present invention.
Figure 2:
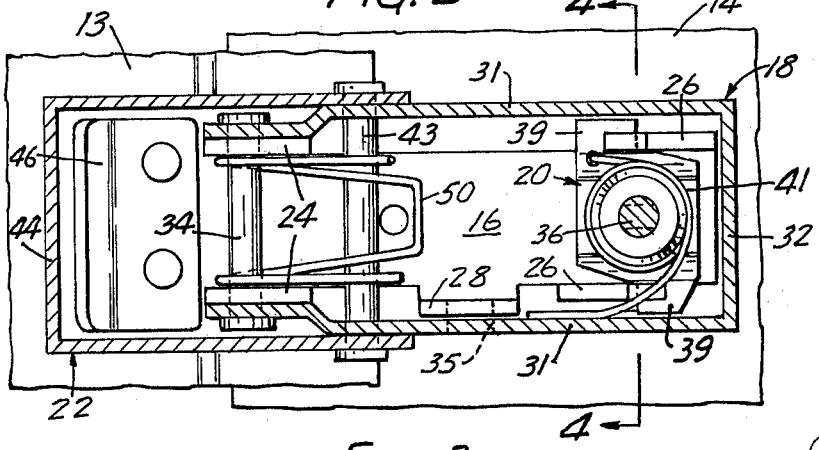
FIG. 2 is a top view of one of the latches sectioned to remove the covering metal to expose the interior parts.
Figure 4:
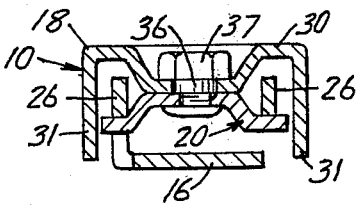
FIG. 4 is a cross-sectional view taken along line 4—4 of FIG. 2.
Figure 5:
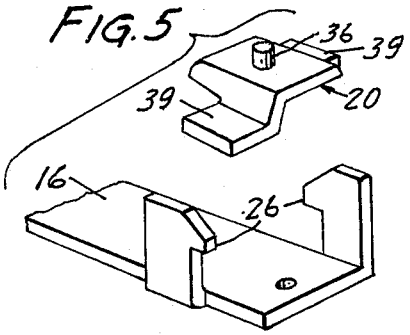
FIG. 5 is a perspective view of the internal latching parts of the latch of FIG. 2.

Two draw and pull latches 10 constructed in accordance with the present invention are illustrated in FIG. 1 in use to secure the overlapping sheet metal doors 13 and 14 of an above ground telephone line connection cabinet 12. Each latch 10 comprises a rectangular base plate 16, a rectangular body 18, a latching plate 20 and a draw and pull nose 22.

The base plate 16 is formed of a heavy gauge metal and it is attached to the right hand cabinet door 14. At one end it is formed along its two opposed edges with similar upstanding pivot flanges 24 and at its opposite end it is formed along its opposed edges with two oppositely directed latching hooks 26. Intermediate its ends the base plate 16 is formed with an upstanding locking flange 28 formed with a padlocking aperture therethrough.

The body is also formed of a heavy gauge metal with a top wall 30, two depending side walls 31 and one depending end wall 32. A shaft 34 passes through the base plate flanges 24 and the body 16 at the open end of the body to pivot the body on the base plate on the outside of the base plate pivot flanges 24. The body 18 extends over and covers the base plate when the parts are in their latched position as illustrated in the drawing. Intermediate its ends the body 18 is formed with aligned padlocking apertures 33 and 35 in its top wall 30 and one of its side walls 31, respectively, which apertures align with the padlocking aperture in the locking flange 28 of the base plate 16 when the body and base plate are in their latched positions.

The latching plate 20 is pivoted on a central pin on the inside of the body, which pin 36 extends through the body and is formed on the outside surface of the body as a hex nut 37. The latching plate 20 is formed at its ends with two latching flanges 39, one in alignment with and opposed to each of the latching hooks 26 on the base plate 16. A torsion spring is captured between the latching plate 20 and the interior of the body 18 to urge the latching plate to a latching position. The hex nut 37 accessible from the exterior of the body 18 is utilized to rotate the latching plate 20 against the force of the torsion spring 41 to unlatch the latching flanges 39 from the latching hooks 26. Rotation of the latching plate 20 with the torsion spring 41 is limited by the contact of the ends of the latching flanges 39 against the side walls 31 of the body 18.

Figure 3:
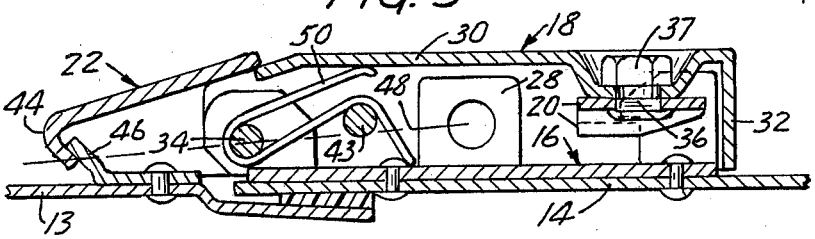
FIG. 3 is a side elevation view of the latch of FIG. 2 with the side removed to expose the interior parts.

The draw and pull nose 22 is pivoted on the outside of the body sidewalls 31 on a shaft 43 adjacent the body pivot shaft 34. The pivot axis of the nose 22 is spaced from the open end of the body further than and is parallel to the pivot axis of the body 18 on the base plate 16. The draw and pull nose 22 covers the open end of the body 18 and has a depending end wall 44 which is turned back toward its opposed end for engaging a keeper 46 on the left hand cabinet door 13. When the latch 10 is in a fully latched position with the nose 22 engaging the keeper 46 and the latching hooks 26 engaging the latching flanges 39 of the latching plate 20, as illustrated in FIG. 3, a plane, illustrated by broken line 48, through the keeper engaging area on the end wall 46 and the pivot axis of the body 18 on the base plate 16 lies between the pivot axis of the draw and pull nose 22 and the base plate 16. The line of force in the latched position illustrated in FIG. 3 is along the plane 48 and thus when the hex nut 37 is turned to unlatch the latching flanges 39 from the latching hooks 26 the body 18 will be urged away from the base plate 16 to move the latch to a fully open position without the necessity of pulling or prying on the body 18.

A wire-form spring 50 extends around the body pivot shaft 34 and over the nose pivot shaft 43 to capture it in the body 18. In the latched position illustrated in FIG. 3, the wire spring 50 presses against and is resiliently deformed by the base plate 16. This spring 50 is provided to assist in moving the body 18 away from the base plate 16 to fully unlatch the latch when the latching flanges 39 are disengaged from the latching hooks 26.

In use, the latch 10 is attached to one cabinet door 14 by bolting the base plate 16 to the cabinet door. The keeper 46 is bolted to the other cabinet door 13 in alignment with the draw and pull nose 22 of the latch 10. To secure the cabinet 12, the hex nut 37 is first turned to an unlatching position and the body 18 is moved away from the base plate 16 thereby moving the latching end wall 44 of the draw and pull nose 22 beyond the keeper 46 on the other door 13. With the end wall 44 of the draw and pull nose 22 engaging the keeper 46 the body 18 is pivoted toward the base plate 16 to pull on the keeper 46 and draw the cabinet doors 13 and 14 into proper alignment and fit. As the body 18 approaches its fully latched position the latching flanges 39 of the latching plate 20 engage upper cam surfaces on the latching hooks 26 which pivot the latching plate 20 against the torsion spring 41 until the latching flanges 39 pass beneath the latching hooks whereupon the torsion spring 41 returns it to a fully latched position firmly engaging the latching flanges 39 with the latching hooks 26. The cabinet 12 is then securely latched. For additional assurance against vandalism the hook of a padlock may be inserted through the padlocking apertures 33 and 35 in the body and the aligned aperture in the locking flange 28 of the base plate 16.

With the latch 10 in the fully latched position illustrated in the drawings, unlatching simply requires turning of the hex nut 37 against the torsion spring 41 to disengage the latching flanges 39 from the latching hooks 26. The forces developed upon latching the latch 10 will then cause the body 18 to move away from the base plate 16 to the open position and the wire form spring 50 will assist in this.

I claim:

1. A draw and pull latch comprising:

a rectangular base plate for attachment to one portion of the structure to be latched, said base plate at one end being formed along its two opposed edges with similar upstanding pivot flanges, being formed at its opposite end with at least one upstanding latching hook and being formed intermediate its end with an upstanding locking flange having an aperture therethrough, a rectangular body having a top wall, two depending side walls and one depending end wall, pivoted at its open end on said base plate on the outside of said base plate pivot flanges, said body extending over and covering said base plate in the latched position and being formed with an aperture in one side wall which, in the latched position, is in alignment with said locking flange aperture to permit padlocking of said latch through said aligned apertures, a latching plate pivoted on said body and formed with a latching flange in alignment with and opposed to said latching hook on said base plate, said latching plate being resiliently urged to a latching position by a torsion spring and having its pivot extend through said body and there formed for engagement for pivoting said latching plate to an unlatched position against said torsion spring, and a draw and pull nose pivoted at one end on the outside of the opposed body walls adjacent the pivot axis of said body on said base plate, the pivot axis of said draw and pull nose being spaced from the open end of the body further than and parallel to the body pivot axis on said base plate, said nose covering the open end of said body and having a depending end wall turned back toward its opposed end for engaging a keeper on the structure to be latched, a plane through the keeper engaging area on said end wall and the pivot axis of said body on said base plate lying between the pivot axis of said draw and pull nose on said base plate when said latch is in a fully latched position with said nose engaging a keeper and said latching hook engaging said latching flange of said latching plate.

2. The latch of claim 1 including a spring between said base plate and said body resiliently urging them to pivot to an unlatched position to assist in opening said latch.

* * * * *